US007404735B2

(12) United States Patent
Reker et al.

(10) Patent No.: US 7,404,735 B2
(45) Date of Patent: Jul. 29, 2008

(54) JUNCTION BOX INCLUDING CONNECTORS AND SURROUNDING HOUSINGS

(75) Inventors: Stefan Reker, Bielefeld (DE); Jürgen Metzler, Oelsnitz (DE)

(73) Assignee: Weidmiller Interface GmbH & Co. KG, Detmold (DE)

( * ) Notice: Subject to any disclaimer, the term of this patent is extended or adjusted under 35 U.S.C. 154(b) by 223 days.

(21) Appl. No.: 11/351,530

(22) Filed: Feb. 10, 2006

(65) Prior Publication Data

US 2006/0193589 A1 Aug. 31, 2006

(30) Foreign Application Priority Data

Feb. 26, 2005 (DE) ..... 20 2005 003 124

(51) Int. Cl.
*H01R 13/405* (2006.01)

(52) U.S. Cl. ..... 439/540.1; 439/320

(58) Field of Classification Search ..... 439/650, 439/652, 76.1, 535, 540.1, 320
See application file for complete search history.

(56) References Cited

U.S. PATENT DOCUMENTS

| | | | | |
|---|---|---|---|---|
| 2,625,591 | A * | 1/1953 | George | 361/601 |
| 2,988,655 | A * | 6/1961 | Rudolph et al. | 307/114 |
| 3,445,805 | A * | 5/1969 | McLoad | 439/277 |
| 3,786,312 | A * | 1/1974 | Roussard | 361/643 |
| 3,990,763 | A * | 11/1976 | Kress | 439/652 |
| 4,181,844 | A * | 1/1980 | Moretto | 307/157 |
| 4,361,373 | A * | 11/1982 | Gallusser et al. | 439/312 |
| 5,227,955 | A * | 7/1993 | Le Bris et al. | 361/743 |
| 5,897,399 | A * | 4/1999 | Emery | 439/709 |
| 5,900,684 | A * | 5/1999 | Lam | 307/139 |
| 6,155,871 | A * | 12/2000 | Machado | 439/535 |
| 6,210,179 | B1 * | 4/2001 | Lausberg et al. | 439/76.1 |
| 6,229,691 | B1 * | 5/2001 | Tanzer et al. | 361/622 |
| 6,527,599 | B2 * | 3/2003 | Bechtold et al. | 439/736 |
| 6,634,910 | B2 * | 10/2003 | Lieb et al. | 439/715 |
| 6,811,444 | B2 * | 11/2004 | Geyer | 439/650 |
| 6,853,316 | B2 * | 2/2005 | Payson et al. | 340/999 |
| 7,021,974 | B2 * | 4/2006 | Sichner et al. | 439/717 |
| 7,230,820 | B2 * | 6/2007 | Reker | 361/641 |

FOREIGN PATENT DOCUMENTS

DE 103 31 441 A1 2/2005

* cited by examiner

*Primary Examiner*—Neil Abrams
(74) *Attorney, Agent, or Firm*—Lawrence E Laubscher, Sr.; Lawrence E Laubscher, Jr.

(57) ABSTRACT

A junction box assembly includes a support board, a connector supported at one end by the support board, a separate tubular guide sleeve arranged concentrically about the connector, and a cover having an open bottom chamber receiving the connector, and a top wall containing an opening receiving the upper ends of the guide sleeve and the connector, thereby to afford electrical connection to the connector by an associated second connector. The guide sleeve is restrained against rotation relative to the cover, the upper end of the guide sleeve being internally threaded for connection with the externally threaded lock nut on the second connector. The guide sleeve and the cover are formed from different synthetic plastic materials.

3 Claims, 2 Drawing Sheets

Fig. 2
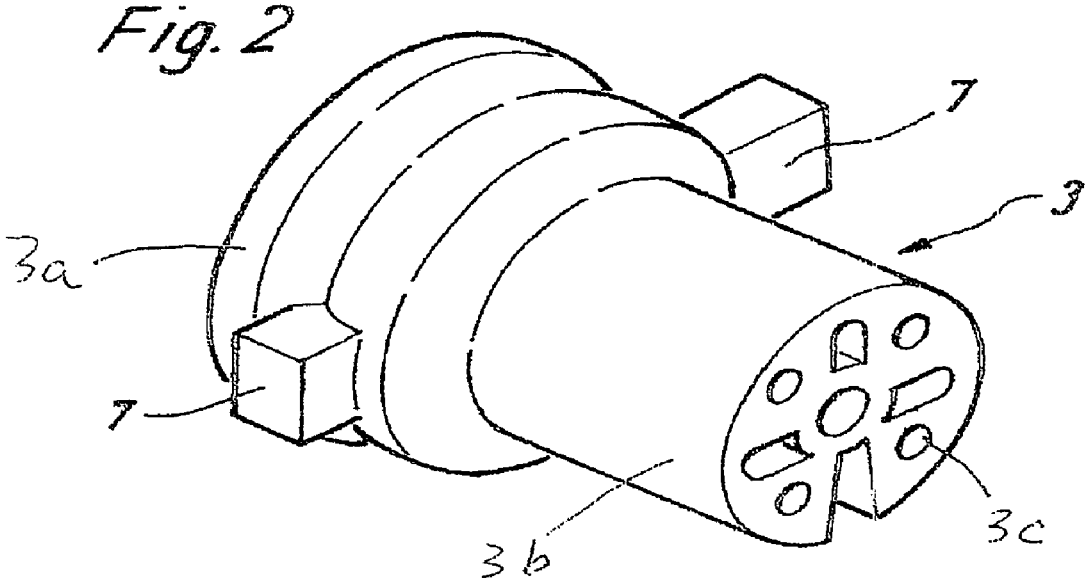
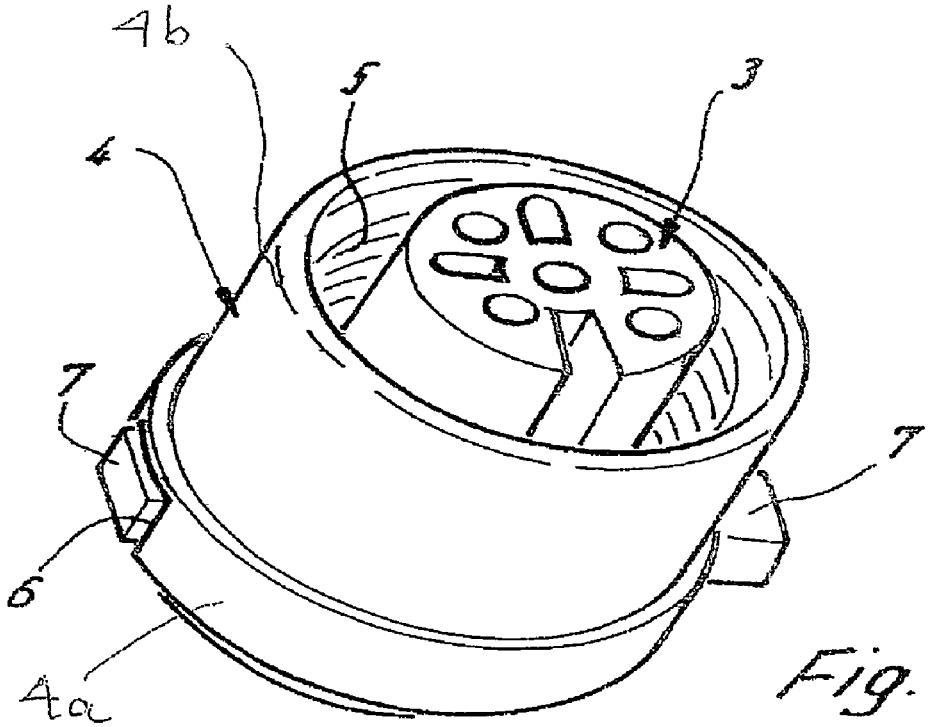
Fig. 3

JUNCTION BOX INCLUDING CONNECTORS AND SURROUNDING HOUSINGS

BACKGROUND OF THE INVENTION

1. Field of the Invention

A junction box assembly includes a support board, a connector supported at one end by the support board, a separate tubular guide sleeve arranged concentrically about the connector, and a cover having an open bottom chamber receiving the connector, and a top wall containing an opening receiving the upper ends of the guide sleeve and the connector, thereby to afford electrical connection to the connector by an associated second connector.

2. Description of Related Art

Junction boxes have been proposed in the prior art including a plastic housing containing a plurality of connectors that are received in the plastic housing for the connection of electrical conductors of preferably multi-wire cables, whereby each connector is surrounded by a guide sleeve. Examples of such junction boxes are presented by the Bechtold et al U.S. Pat. No. 6,527,599, and the German published application No. DE 103 31 441 A1.

There are designs where the synthetic plastic housing is made in one piece with the guide sleeves. There are also designs where the guide sleeves are made as separate parts from metal and are fixed within in the plastic housing.

The first-mentioned design possesses the disadvantage that relatively expensive tools are needed to be able to make the plastic housing with the integrally molded-on guide sleeves. Another disadvantage consists in that in the case of the individual design, the guide sleeves and the plastic housing, moreover, naturally consist of the same material so that there is no possibility here of selecting materials that would meet the requirements of the guide sleeves, on the one hand, and of the plastic housing, on the other hand, to any particular degree.

The second design possesses the disadvantage that the guide sleeves that are made of metal are comparatively expensive in cost.

The present invention was developed to provide a junction box or distributor that can be manufactured both easily and at reasonable cost, and that offers the possibility of using materials that meet different requirements for the plastic housing, on the one hand, and for the guide sleeves, on the other hand. This problem is solved according to the invention in that the guide sleeves in each case are made as individual parts from plastic and are fixed in the plastic housing. The guide sleeves are thus made of plastic, just as is the plastic housing, whereby one can use differing materials throughout for the mentioned parts.

The plastic housing can be made of a material that ideally meets the special requirements for the plastic housing. The same applies to the guide sleeves, whereby in this case, there may certainly be other requirements to be met so that other materials can be used correspondingly for the production of the guide sleeves. The guide sleeves are non-rotatably fixed by a press-fit within corresponding openings contained in the synthetic plastic housing.

Naturally, other possibilities of attachment are also conceivable, for example, the guide sleeves can also be fixed in a form-locking manner or in an adhesively bonded locking manner in the plastic housing. The guide sleeves are provided at their front end with at least one axially extending cutout in which engages a radially protruding extension arm of a contact insert in a form-locking manner. In this way, one can prevent any twisting or relative rotation between the particular connector and the particular associated guide sleeve. As is known, the guide sleeves can be provided with an interior thread, preferably a metric inside thread.

SUMMARY OF THE INVENTION

Accordingly, a primary object of the present invention is to provide a junction box assembly including a support board, a connector supported at one end by said support board, a separate tubular synthetic plastic guide sleeve arranged concentrically about the connector, a cover having an open bottom chamber receiving the connector, said cover having a top wall containing an opening receiving the upper end of the connector, and means preventing rotation of said guide sleeve relative to the cover.

According to a further object of the invention, radial lug and slot means are provided for preventing rotation of the guide sleeve relative to the connector.

Another object of the invention is to provide a guide sleeve that is internally threaded at its end that is mounted with the cover opening, whereby a second connector that is electrically connected with the board-mounted connector may be fastened to the sleeve by an externally threaded lock nut.

BRIEF DESCRIPTION OF THE DRAWINGS

Other objects and advantages of the invention will become apparent from a study of the following specification, when viewed in the light of the accompanying drawing, in which:

FIG. 2 is a detailed perspective view of one of the electrical connector of FIG. 1; and FIG. 3 is a detailed perspective view of one of the separate guide sleeves of FIG. 1.

DETAILED DESCRIPTION OF THE INVENTION

Figure 1:
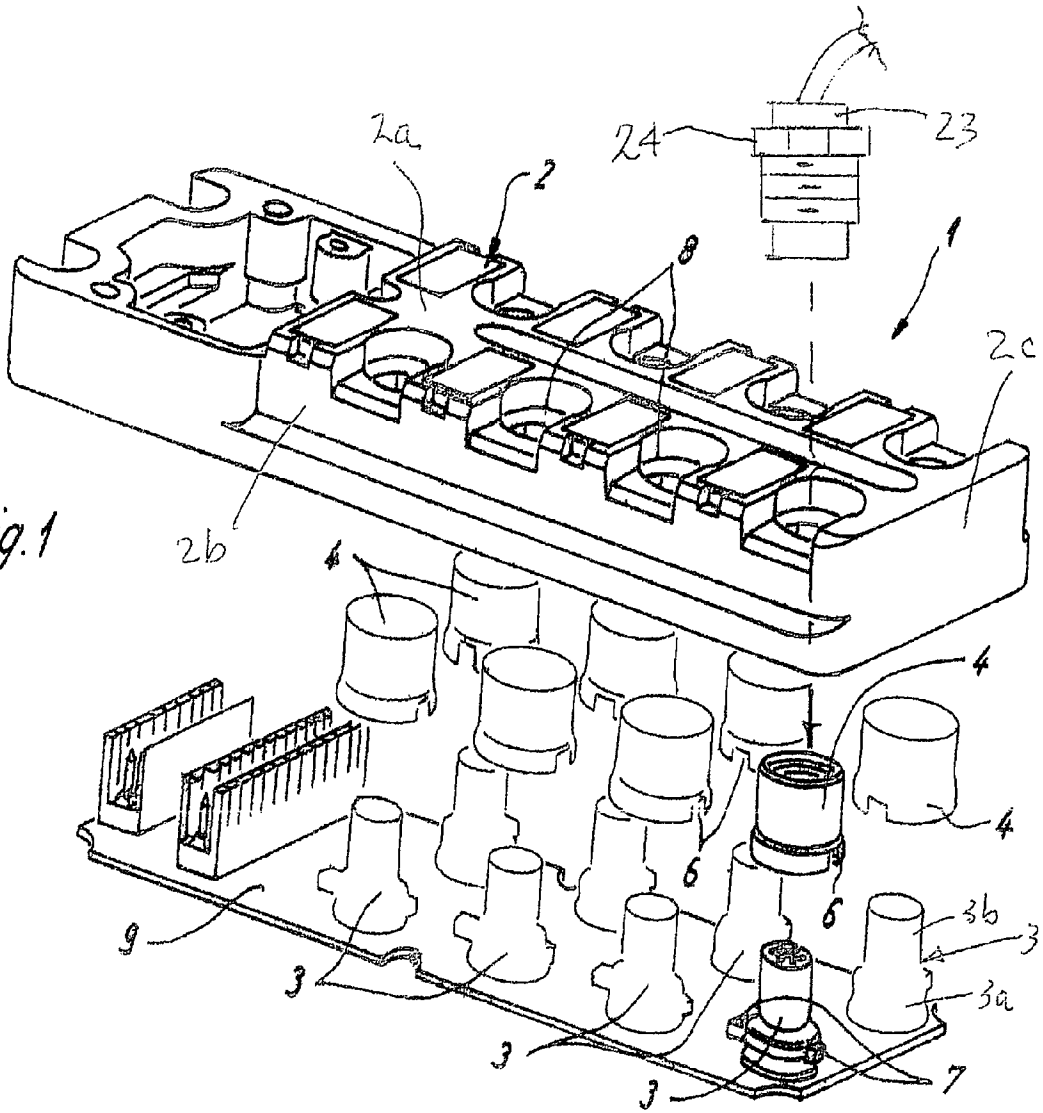
FIG. 1 is an exploded side perspective view of the junction box assembly of the present invention.

Referring first more particularly to FIG. 1, the junction box assembly 1 includes a synthetic plastic cover 2 having a horizontal top wall 2*a*, and downwardly extending side 2*b* and end 2*c* walls that cooperate to define an open-bottom chamber. Arranged below the cover is a support board 9 that carries a plurality of upwardly extending electrical connectors 3. The bottom ends 3*a* of the connectors 3 are fastened or screwed into openings contained in the support board 9, and the connector upper ends 3*b* are provided with a plurality of terminals 3*c* (FIG. 2).

In accordance with a characterizing feature of the present invention, there are arranged concentrically about each of the connectors a plurality of separate tubular synthetic plastic guide sleeves 4. The respective configurations of the connectors and the guide sleeves are such that the lower ends 4*a* of the guide sleeves are in engagement with the outer surfaces of the lower ends 3*a* of the connectors, and the upper ends 4*b* of the guide sleeves are concentrically spaced from the corresponding upper ends 3*b* of the connectors. Rotation of each guide sleeve 4 relative to its associated connector 3 is prevented by the cooperation between diametrically arranged, radially outwardly extending lugs 7 on the lower ends of the connectors, and corresponding diametrically arranged slots 6 contained in the end extremities of the guide sleeves, as best shown in FIG. 3. The inner surfaces 5 of the guide sleeves are threaded for connection with lock nuts on corresponding electrical connectors, as will be described in greater detail below.

The upper ends 4*b* of the guide sleeves extend, preferably by a press fit, within corresponding openings 8 contained in the cover top wall 2, thereby to prevent rotation of the guide sleeves relative to the cover. Alternatively, the guide sleeves 4 may be prevented from rotation relative to the cover openings 8 by layers of a suitable adhesive, or by other fastening means, such as a screw-thread coupling between the components, by fastening nuts, or the like.

Assuming that the guide sleeves 4 are fastened to and are carried by the cover 2, in order to assembly the junction box, the cover and guide sleeves 4 are lowered as a unit relative to the support board 9, whereupon the connectors 3 are progressively introduced within the corresponding guide sleeves 4 until the radial lugs 7 extend into the corresponding locking slots 6. Alternatively, with the guide sleeves 4 non-rotatably mounted on the connectors 3 with the lugs 7 extending into the slots 6, the cover 2 may be lowered to cause the upper ends 4*b* of the guide sleeves 4 to extend within the top wall openings 8. The guide sleeves are non-rotatably mounted within the openings, either by means of a press fit, or by other means, such as an adhesive layer, or separate fastener means. In either case, the use of separate guide sleeves 4 provides the advantage that different synthetic plastic materials maybe used, whereby the components may have different physical properties, as desired.

In either case, the associated second connectors 23 may now be electrically connected with the terminals 3*c* at the exposed upper ends 3*b* of the connectors 3, whereupon the locking nuts 24 on the second connectors are rotated to effect locking engagement between the external threads on the locking nuts and the internal threads on the upper ends 4*b* of the sleeves.

While in accordance with the provisions of the Patent Statutes the preferred forms and embodiments of the invention have been illustrated and described, it will be apparent to those skilled in the art that changes may be made without deviating from the invention described above.

What is claimed is:

1. A junction box assembly, including:

(a) a horizontal support board (9);

(b) at least one cylindrical vertically-arranged electrical connector (3) having a lower end (3*a*) connected with said support board, and an upper end (3*b*) having a plurality of electrical terminals (3*c*);

(c) a tubular synthetic plastic guide sleeve (4) arranged concentrically about said connector, the lower end (4*a*) of said guide sleeve being in engagement with said conductor lower end, the upper end (4*b*) of said guide sleeve being concentrically spaced from said connector upper end;

(d) a synthetic plastic cover (2) connected with said support board, said cover having horizontal top (2*a*) and vertical side (2*b*) and end (2*c*) walls cooperating to define an open-bottom chamber, said top wall containing an opening (8), said cover being arranged above said support board with said connector and said guide sleeve extending into said chamber, the upper end of said guide sleeve being received within said cover opening; and (e) rotation preventing means preventing rotation of said guide sleeve relative to said cover, said rotation preventing means including cooperating radial lug (7) and slot (6) means preventing rotation of said guide sleeve relative to said connector.

2. A junction box assembly as defined in claim 1, wherein said guide sleeve upper end has an inner surface (5) that is threaded; and further including:

(f) a second connector (23) electrically connector with said board-mounted connector, said second connector including locking nut means (24) threadably connected with said guide sleeve inner surface.

3. A junction box assembly including:

(a) a horizontal support board (9) formed from a first synthetic plastic material;

(b) at least one cylindrical vertically-arranged electrical connector (3) having a lower end (3*a*) connected with said support board, and an upper end (3*b*) having a plurality of electrical terminals (3*c*);

(c) a tubular synthetic plastic guide sleeve (4) arranged concentrically about said connector, the lower end (4*a*) of said guide sleeve being in engagement with said conductor lower end, the upper end (4*b*) of said guide sleeve being concentrically spaced from said connector upper end, said cover and said guide sleeve being formed from different synthetic plastic materials;

(d) a synthetic plastic cover (2) connected with said support board, said cover having horizontal top (2*a*) and vertical side (2*b*) and end (2*c*) walls cooperating to define an open-bottom chamber, said top wall containing an opening (8), said cover being arranged above said support board with said connector and said guide sleeve extending into said chamber, the upper end of said guide sleeve being received within said cover opening; and (e) rotation preventing means preventing rotation of said guide sleeve relative to said cover.

* * * * *